United States Patent [19]

McGill et al.

[11] Patent Number: 4,534,157

[45] Date of Patent: Aug. 13, 1985

[54] CASE LIFT OUTFEED APPARATUS

[75] Inventors: Robert W. McGill, Munroe Falls; Chris E. Robinson, Akron, both of Ohio

[73] Assignee: Figgie International Inc., Willoughby, Ohio

[21] Appl. No.: 393,463

[22] Filed: Jun. 29, 1982

[51] Int. Cl.[3] ..... B65B 43/52; B65B 5/06; B65B 21/16

[52] U.S. Cl. ..... 53/531; 53/247; 53/249; 198/435; 198/472; 198/631

[58] Field of Search ..... 53/247, 248, 249, 531; 187/24, 25; 414/659; 198/485, 574, 586, 631, 472

[56] References Cited

U.S. PATENT DOCUMENTS

| | | | |
|---|---|---|---|
| 2,819,576 | 1/1958 | Hendricks et al. | 53/247 X |
| 2,952,955 | 9/1960 | Leichenich et al. | 53/247 X |
| 3,344,902 | 10/1967 | Crawford | 198/631 X |
| 3,403,799 | 10/1968 | Sindzinski et al. | 198/435 X |
| 3,844,402 | 10/1974 | Hayashi | 198/472 |
| 4,406,110 | 9/1983 | McGill | 53/249 |
| 4,446,672 | 5/1984 | Raudat | 53/247 X |

*Primary Examiner*—Horace M. Culver

*Attorney, Agent, or Firm*—Oldham, Oldham & Weber Co.

[57] ABSTRACT

A case lift apparatus having a case receiving platform and a powered lift cylinder operatively connected to the platform to raise and lower the same, and a pair of endless extensible belts operatively journalled on the platform in spaced parallel relation, with a horizontal course positioned slightly above the upper surface of the platform for support of cases on said platform and a lower course positioned below the platform; and a driving roll means below the platform to engage and drive the belts when the platform is at or approaching its lowered position.

11 Claims, 8 Drawing Figures

CASE LIFT OUTFEED APPARATUS

TECHNICAL FIELD

This invention relates to the art of packaging articles and especially to improved quicker functioning case lift support mechanism for reciprocatory vertical movement to receive a group of articles in the case and discharge the article filled case.

BACKGROUND ART

Heretofore there have been many different types of apparatus provided for packaging articles and the soft drink and beverage industry as a whole has been particularly active in the design and production of various types of apparatus for processing a stream of abutted articles by arranging such articles into groups for filling cases, which article groups are collected upon a grid adapted to drop the articles through it into a case provided on a case lift mechanism positioned below the grid. The case lift mechanism is adapted to receive an empty case thereon, lift the empty case, have the group of articles on the grid released for deposit into the case, the grid lift or case lift mechanism is lowered, the filled case is removed from the lift apparatus, and the cycle is then repeated. Naturally these article grouping actions must be performed rapidly. It is very desirable in the art that compact apparatus be provided and that the apparatus function efficiently and rapidly for maximum safe processing of large numers of articles in a minimum amount of time. Various types of case lift apparatus have been provided heretofore and one commercial construction on the case lift means is shown in U.S. Pat. No. 26,906. A typical structure is covered in U.S. Pat. No. 3,052,071 for grouping the articles; dropping the articles down through a grid on the apparatus for receipt into an empty case positioned below the case filling area of the machine.

In this group packaging of articles, naturally it is desirable that the articles be processed safely and efficiently. While other types of apparatus have been provided, the present invention particularly relates to the type of apparatus wherein an empty case is fed to a case lift mechanism, the left mechanism is actuated to move it and the case to an upper position, the articles are dropped down into the case, the filled case is lowered and is discharged, or outfed from the case lift platform. Since speed is so desirable in apparatus of this type, I have now found a way to reduce the overall time cycle involved for the case lift apparatus including receipt of an empty case thereon, raising the case for article filling action, lowering the case and discharging the case.

DISCLOSURE OF INVENTION

It is the general object of the invention to provide an improved apparatus especially adapted for a rapid cycle of case lift, fill and discharge in article packaging apparatus.

Another object of the invention is to provide an inexpensive, uncomplicated positive apparatus for expediting removal of filled cases from a case lift platform in article packaging apparatus.

Another object of the invention is to provide a flexible belt case support on a case lift platform wherein the belt has the case supported thereon and drive of the belt removes the case from the platform and may aid in the feed of empty cases to the platform.

Another object of the invention is to provide a flexible, expandable plastic belt means having plastic memory for supporting cases on a case lift platform to enable removal of the filled case to start during the downward movement of a filled case in the apparatus.

Other objects of the invention are to overcome the static inertia of a filled case on the case lift mechanism and get some momentum into the filled case prior to bottoming of the case lift mechanism in its operative cycle; to reduce the weight of the case lift mechanism and to provide a separate member apart from the case lift mechanism for case outfeed drive to reduce the overall weight of the case lift mechanism; to provide an adjustment for the portion of the downfeed movement of a case lift mechanism in which to start outfeed drive of a filled case on the case lift platform; and to provide proper interrupted drive to belt support means for cases on a case lift platform to obtain case deposit onto the platform and removal of the filled case supported on the belt means on the platform.

The foregoing and other object and advantages of the invention will be made more apparent as the specification proceeds are achieved by: a case lift apparatus including, a frame, a receiving platform and powered lift cylinder operatively connected to said platform to raise and lower the same, the improvement comprising: a pair of endless extensible belts operatively journalled on said platform in spaced parallel relation, said belts having a horizontal course positioned slightly above the upper surface of said platform for support of cases on said platform, said belts also having a lower course positioned below said platform; and a driving roll means journalled on said frame below said platform and adapted to engage and drive said belts when said platform is at its lowered position, said driving roll means also engaging the lower course of said belts when said platform is being lowered and is adjacent its bottom position.

While the apparatus of the present invention can be used, in general, in ay case lift apparatus known in the art, the apparatus is particularly designed to work with the power cylinder lift mechanism shown and described in Robert W. McGill's patent application, Ser. No. 189,707 filed Oct. 1, 1980 now U.S. Pat. No. 4,406,110. Details of the power cylinder lift means are shown and described in such application.

BRIEF DESCRIPTION OF DRAWINGS

Attention now is particularly directed to the accompanying drawings, wherein.

When referring to the corresponding members shown in the drawings and referred to in the specification, corresponding numerals are used to facilitate comparison therebetween.

BEST MODE FOR CARRYING OUT THE INVENTION

Figure 1:
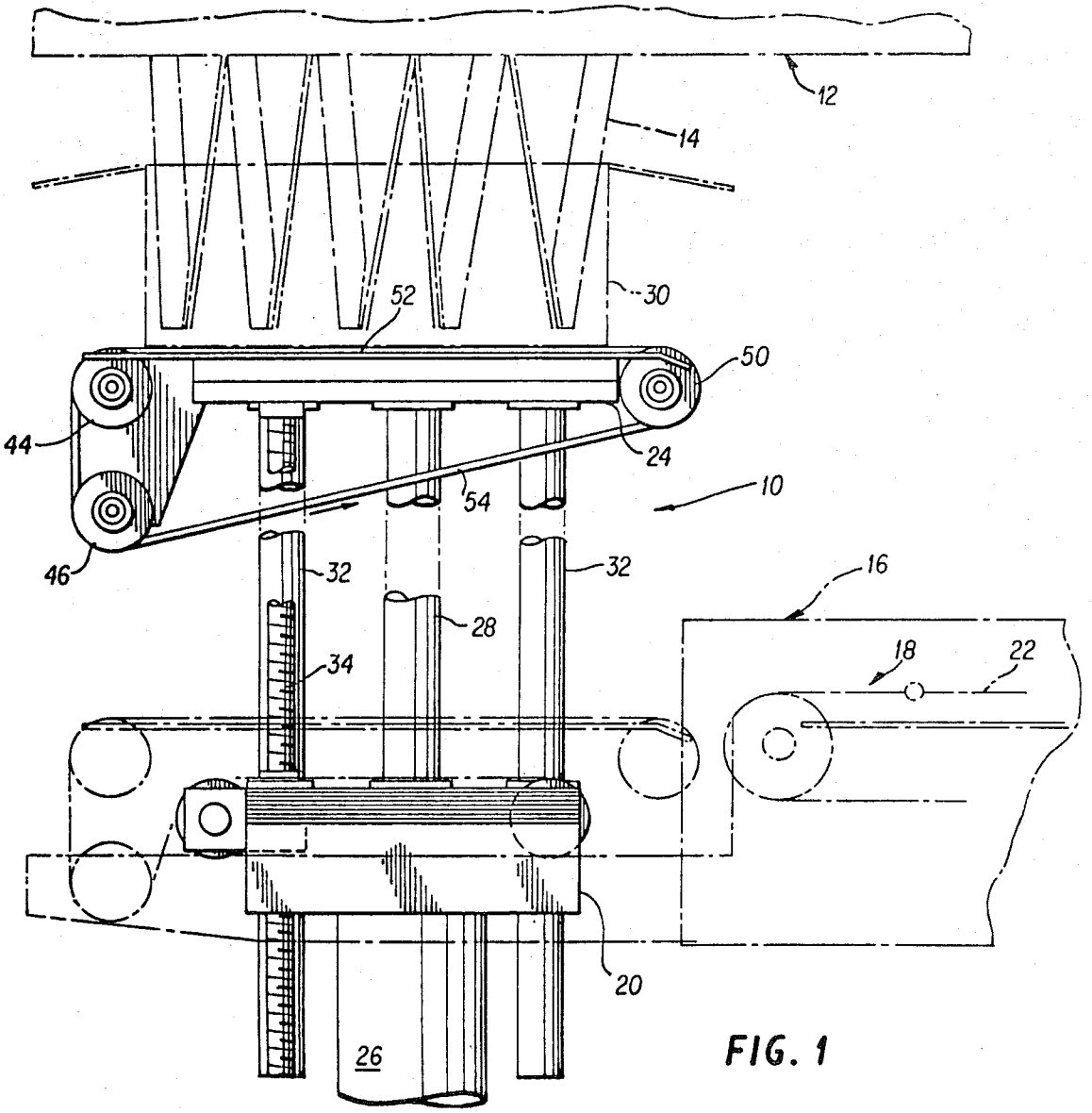
FIG. 1 is a side elevation of the case lift outfeed apparatus of the invention, with portions of the apparatus broken away, as applied to a known type of article packaging apparatus.

A case lift outfeed apparatus 10 is shown in FIG. 1 and it is shown in association with a grid 12 positioning a plurality of sets of drop fingers 14 depending therefrom. This grid 12 is provided at a case packer feed area of an article case packer apparatus 16, only a portion of which is shown. Such case packer apparatus 16 includes a case supply mechanism and a frame 20. The case supply mechanism 18 normally includes some type of an endless conveyor 22 that supplies empty cases in predetermined timed relationship to a case receiving platform 24.

The case receiving platform 24 is operatively positioned at the article drop area of the case packer 16 and the platform is positioned by known means, such as a powered cylinder 26 including a pistonrod 28. Such cylinder is operatively positioned on the frame and the piston rod 28 engages and supports the case receiving platform to position it for reciprocatory movement up and down on the vertical axis of the piston rod 28 to bring the platform and any empty case 30 positioned thereon to a position immediately below and in alignment with the dependent drop fingers 14 of the apparatus. Articles collected upon the grid 12 can be dropped through these sets of drop fingers 14 to fill the case 30. This case had been supplied by the conveyor 22 to the case lift platform after which the platform is raised to the solid line position shown in FIG. 1 from the dotted line position shown in FIG. 1 for article deposit action.

The case receiving platform lift means or cylinder 26 includes a pair of guide rods 32 which extend through part of the frame 20 in suitable slide arrangement therewith prevent any arcuate movement of the case receiving platform 24. Rod 34 is shown and it is provided for adjustment of the length of stroke of the piston rod 28 in the cylinder 26, all as explained in more detail in the companion copending U.S. application Ser. No. 189,707 U.S. Pat. No. 4,406,110 referred to hereinabove.

Figure 8:
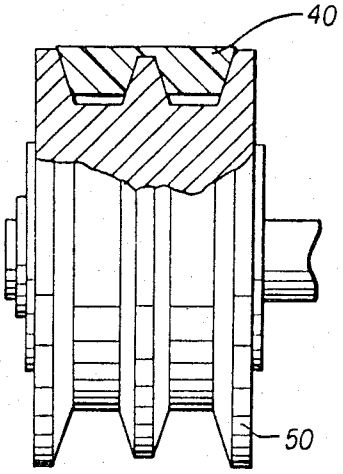
FIG. 8 is a fragmentary vertical section through a belt and its supporting pulley.
Figure 4:
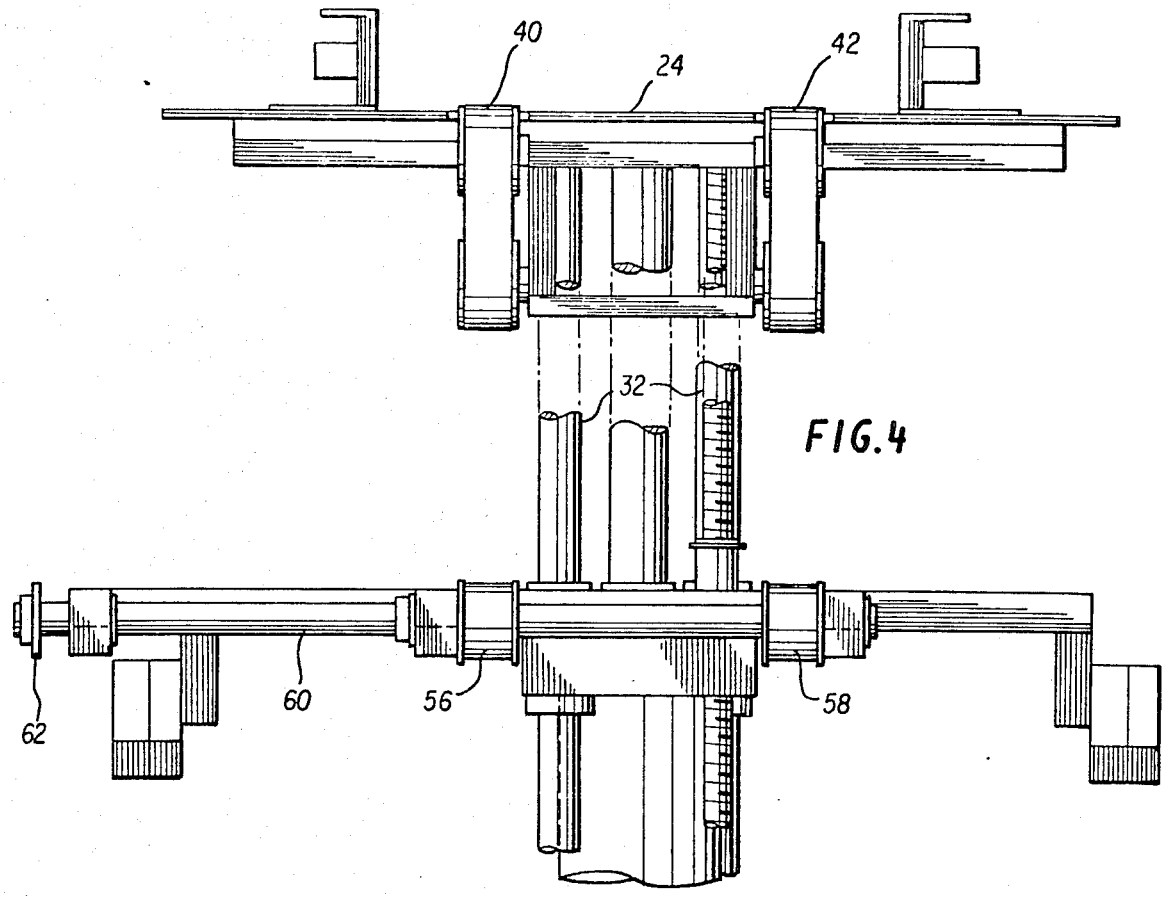
FIG. 4 is an end elevation of the case lift apparatus in its elevated position.
Figure 5:
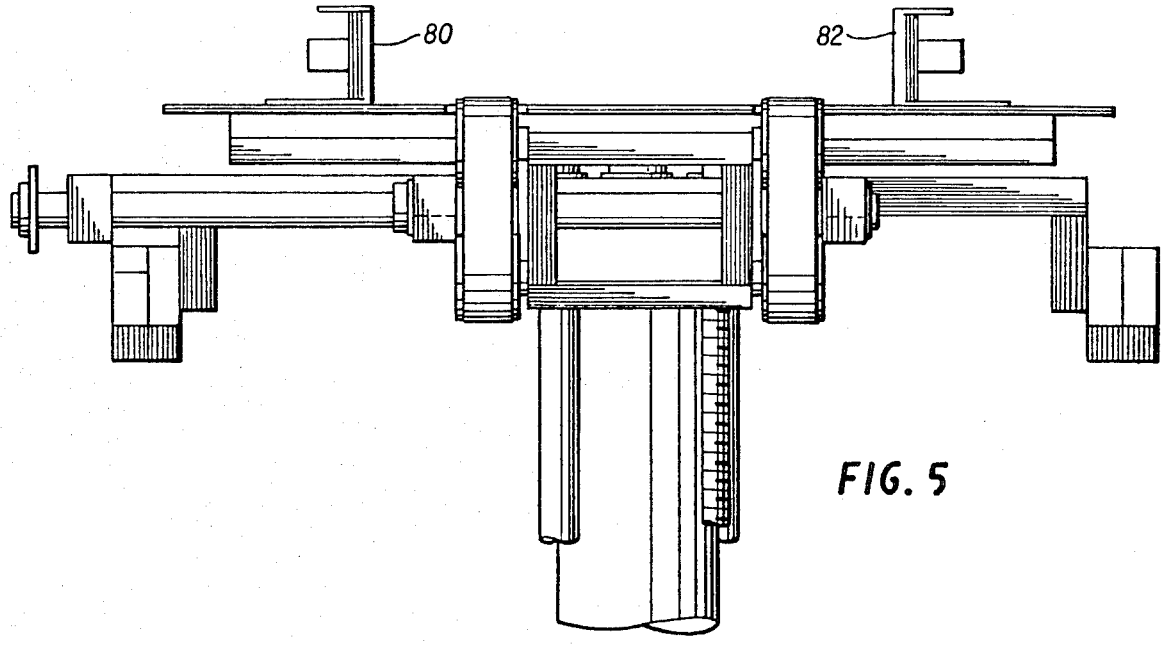
FIG. 5 is an elevation of FIG. 4 of the case lift apparatus in its lowered position.

As an important feature of the present invention, a pair of parallel endless extensible belts 40 and 42 are operatively journalled on the case receiving platform 24. Thus, a pair of vertically aligned pulleys 44 and 46 are journalled on a bracket 48 that depends from a downstream margin of the case receiving platform. A third pulley 50 is provided at the upstream margin of the case receiving platform adjacent its upper surface whereby the belts 40 and 42 can be positioned to have an operative upper course 52 which is horizontally directed and wherein the belts 40 and 42 are positioned slightly above the adjacent support surface of the case receiving platform 24. The belts also have a lower course 54 wherein the belts are, when driven, moving in an upstream, upwardly inclined direction. These pulleys 44, 46 and 50, FIG. 4, are all positioned laterally externally of the piston rod 28 and the guide rods 32 to clear them of the other operative mechanism supporting the case receiving platform and also aiding in positioning the belts in their lower course 54 whereby the belts can be deflected upwardly in the apparatus toward the case receiving platform as hereinafter described. These belts 40 and 42 preferably are double belts as shown in FIG. 8 and they mate with the double pulley 50 as shown.

It also should be noted that a pair of driving pulleys 56 and 58, FIG. 4, are secured to a shaft 60 suitably journalled on the frame 20 and having an end portion extending laterally of the frame and carrying a sprocket 62 thereon for engaging a driving chain as later described. These pulleys 56 and 58 are so positioned on the frame as to contact the lower course of the belts 40 and 42 when, for example, the case receiving platform 24 is about 3½ inches up vertically from its lowermost position as controlled by the cylinder 26. Hence, the belts contact these pulleys, and are deflected upwardly out of their normal straight line lower course position shown in solid lines in FIG. 1 to move the belt over to the dotted line configuration as indicated in the lower part of FIG. 1.

Figure 2:
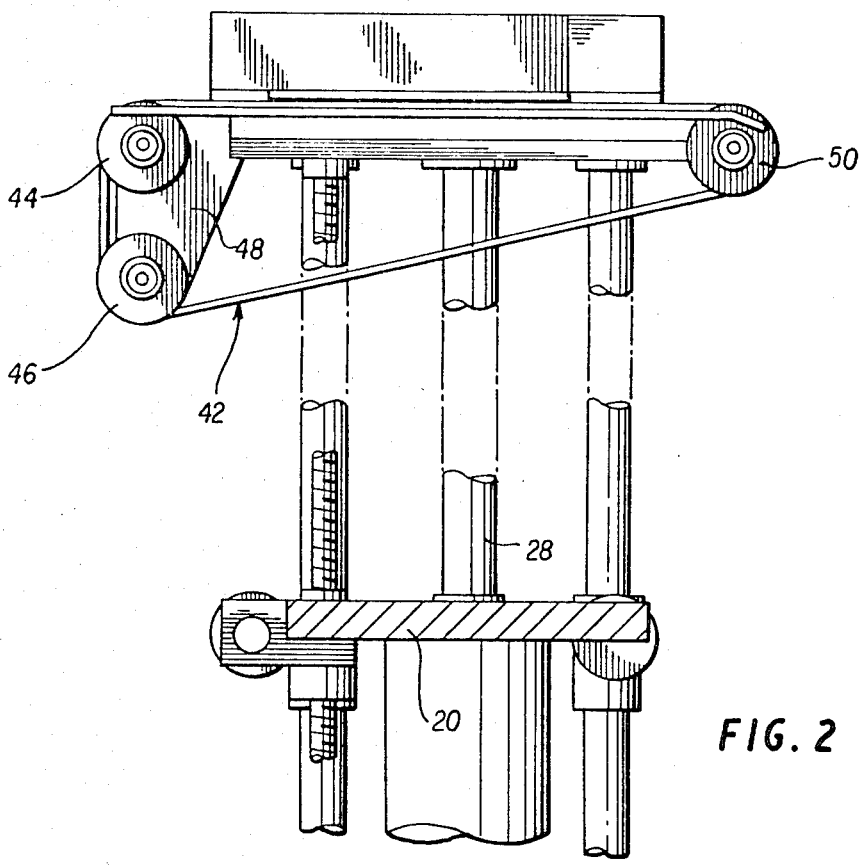
FIG. 2 is a fragmentary side elevation of just portions of the case lift outfeed apparatus of FIG. 1 showing it in its elevated position.
Figure 3:
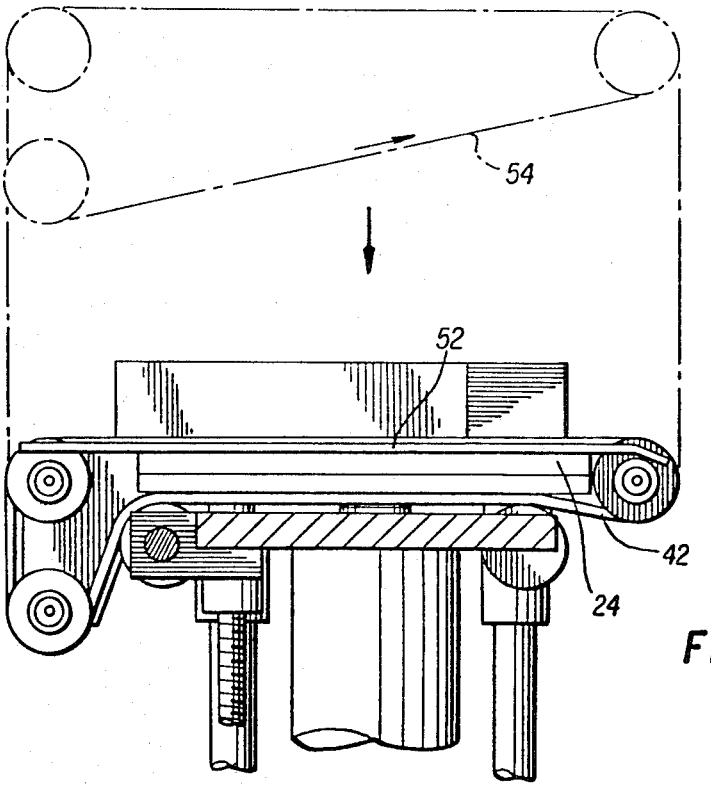
FIG. 3 is a side elevation like FIG. 2 of the case lift apparatus in its lowered position and with the configuration of the case transport belts being indicated in the dotted lines.

It should be understood that the belts 40 and 42 preferably are made from polyurethane and that they have a rapid, positive plastic memory. Specifically, the preferred belts are made by the Eagle Belting Company of Des Plains, Ill. and they are a commercial item. The belts have an excellent, rapid plastic memory whereby the belt is initially made to a desired length and is set up in the apparatus to take the configuration shown in FIG. 2 but wherein the belt can be deflected to taken the configuration shown in FIG. 3 and still have effective driving contact with all pulleys and roller means at that time and maintain such effective contact with the pulleys and mounting means even when permitted to retract to take the triangular shape shown in FIG. 2. Other drive belts or systems may be used such as spring extensible belts or spring loaded belt systems but the polyurethane belts have been preferred for their excellent plastic memories when stretched.

To improve the frictional contact between the driving pulleys 56 and 58 with the belts 40 and 42, preferably the pulleys 56 and 58 have a layer of polyurethane provided on the surface thereof whereby there is a plastic to plastic engagement between the belts and pulleys to maintain effective positive drive action therebetween.

Of course, any drive action for the belts should not be obtained until the case receiving platform 24 has been lowered sufficiently to clear the drop fingers 14 from the case 30 positioned on such platform. The object of the belts 40 and 42 is to overcome the static inertia of the case on the platfom and to create some momentum in the case to start it towards the downstream edge of the case receiving platform prior to bottoming of such platform on its vertical movement axis. This starting of the case discharge action in this manner does aid processing of the filled cases and permits faster cyclical operation of the case packer apparatus 16.

Drive from the apparatus 16, which drives the conveyor 22, is transmitted to the shaft 60 through a one-way clutch air controlled clutch 68 from the machine drive wherein the air controlled clutch is controlled by a timer so that the belts will be driven only when an empty case is being discharged from the conveyor 22 onto the case receiving platform 24. As a prior portion of the belt drive cycle, the belts should be driven for a short interval to move the filled case downstream from its location centered on the platform, which action can be started as the case receiving platform 24 is moving downward and is near its lower extremity. The belt drive can be started even after the belts have established contact with the roller or pulleys 56 and 58 so that drive of the pulleys can start after good frictional contact has been established between these pulleys and the plastic belts 40 and 42.

As previously indicated, the belts protrude vertically slightly above the associated surfaces of the platform whereby the belts readily support the cases thereon and aid in feeding the empty case onto the case receiving platform from its upstream edge and in all events will aid in and control the discharge movement of the filled case from the downstream margin of the case support platform. Any suitable means or conveyor can be provided adjacent the downstream margin of this case receiving platform 24 for receiving filled cases therefrom.

Figure 6:
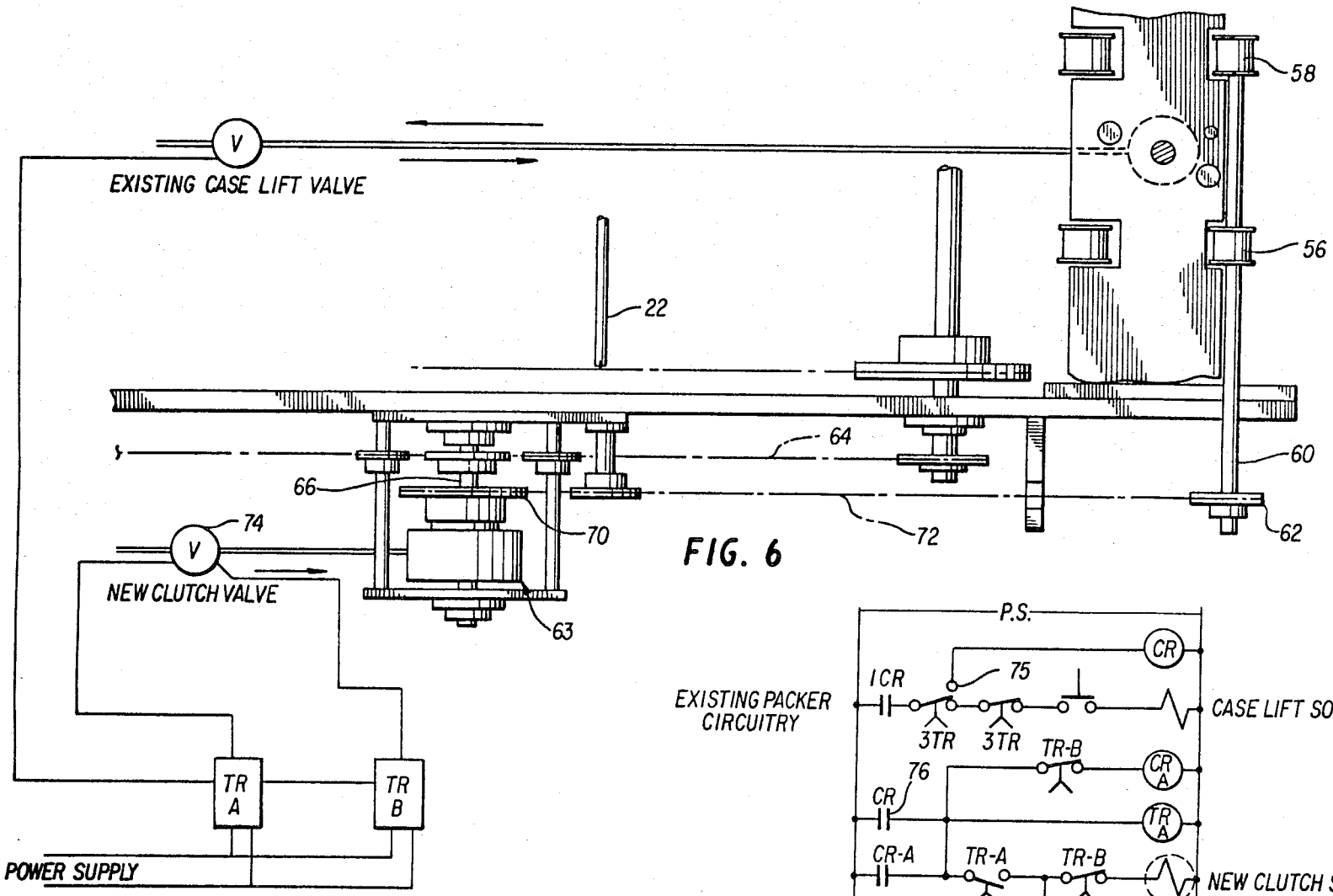
FIG. 6 is a diagrammatic showing of drive means for the belts on the case lift platform.
Figure 7:
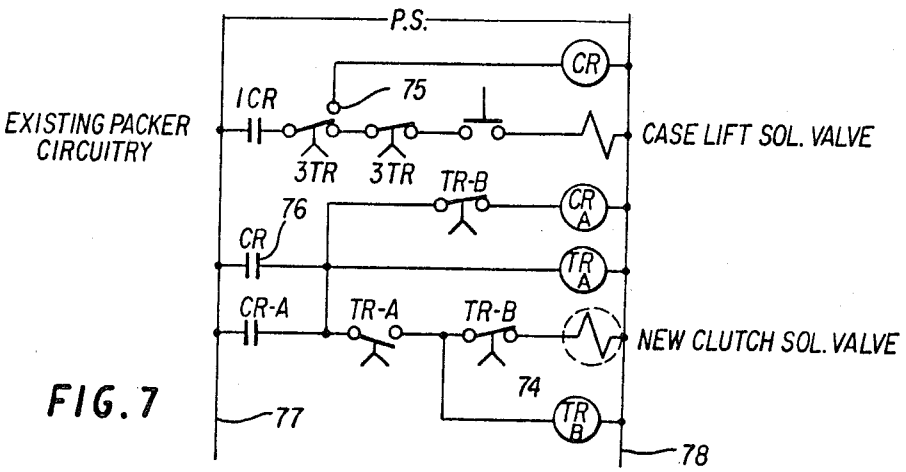
FIG. 7 is a simplified schematic wiring diagram for the case lift outfeed apparatus.

The drive supplied for the belts 40 and 42 is best shown in FIGS. 6 and 7. FIG. 6 shows the conveyor 22 and the drive for such conveyor is transmitted through a drive chain 64. Such drive chain conventionally engages and drives a shaft 66 which has an air operated clutch 68 provided thereon. This clutch 68 in turn controls an output sprocket 70 which connects to an endless chain 72 that connects to the sprocket 62 on the shaft 60. Hence, when the clutch 68 is operative, it will transmit drive to this shaft 60 which otherwise is stationary with no drive supplied therfore. Flow of air to the air operated clutch 68 is controlled by a valve 74 in the compressed by a valve 74 in the compressed air supply line and such air valve is in turn controlled by timers TRA and TRB, which are solenoid operated and which are controlled as hereinafter described.

The diagrammatic circuit of FIG. 7 shows the existing packer circuitry for control of the same but solenoid operated control relay CR has been added. The existing circuit controls the case lift solenoid valve that operates the cylinder 26 for the conventional lift, pack and lower action. Additionally, the timer 3 TR has been so modified so that it closes power supply to control relay CR by engaging contact 75 when it times out from its normal closed position as shown and the control circuit starts the platform down.

When control relay CR is energized, it closes contacts 76 and control relay CR-A and adjustable timer TRA is energized. When timer TRA times out, it activates its control solenoid to send out an impulse to close its contact TR-A to energize the control valve 74 for the clutch and start drive of the shaft 60. Such action starts in controlled time relationship to the cycle of the cylinder in its lift and lower action on the case support platform.

When timer TR-A times out and its control action includes sending an operatively impulse from the power supply lines 77 and 78 to timer TRB. When such timer TRB times out, it is activated to open contact TR-B in the power circuitt for the solenoid operated air valve 74 to cause the solenoid to shut off air supply and drive of the shaft 60 stops. Such shaft has pulled an empty case onto the case support platform. The control has now been reset to start another cycle when the case lift platform has been elevated, articles are dropped into the case, and the platform is ready to be lowered.

It should be realized that other conventional means such as adjustable side guides indicated at 80 and 82 can be provided on the case lift platform as is well known in the art.

By the apparatus of the invention, a relatively lightweight but positive action case lift platform has been provided and it is of reduced weight insofar as not having any of the drive mechanism for the belts 40 and 42 positioned on the case receiving platform or the frame thereof.

The action of the filled case being discharged can be controlled by the adjustable timer mechanism TRA being set to actuate the drive of shaft 60 at a desired time when the platform 24 is lowered. The belts 40 and 42 are engaged by the drive pulleys usually prior to start of drive of the shaft 60.

The apparatus of the invention is easily controlled and provides a positive, durable apparatus for effectively providing discharge of filled cases from the case receiving platform 24 and facilitating reduced times for the complete operative cycle for the case receiving platform in receiving an empty case, being elevated, the case being filled, the filled case being lowered and discharged from the case receiving platform. Immediately thereafter a new empty case is transmitted to the platform and the cycle is repeated. Hence, the new and improved durable apparatus of the invention is believed to meet all of the objects of the invention as set forth hereinabove.

While one complete embodiment of the invention has been disclosed herein, it will be appreciated that modification of this particular embodiment of the invention may be resorted to without departing from the scope of the invention.

What is claimed is:

1. In a case lift apparatus including, a frame, a receiving platform and a powered lift cylinder operatively connected to said platform to raise and lower the same, the improvement comprising:

a pair of endless extensible belts operatively journalled on said platform in spaced parallel relation, said belts having a horizontal course position slightly above the upper surface of said platform for support of cases on said platform, said belts also having a lower course positioned below and spaced from said platform; and a driving roll means journalled on said frame below said platform and adapted to engage and drive said belts when said platform is at or approaching its lower position.

2. In case packer apparatus as in claim 1, where a plurality of pulleys engage and support said belts, said driving roll means engage the lower course of said belts when said platform is being lowered and is adjacent its bottom position, said belts are made from polyurethane and have a positive plastic memory whereby said belts can be stretched as said driving roll means engage said belts.

3. In a case lift apparatus including, a frame, a receiving platform and powered lift cylinder positioned on said frame and operatively connected to said platform to raise and lower the smae, the improvement consisting:

a pair of endless members operatively journaled on said platform in spaced parallel relation, said members having a horizontal course positioned slightly above the upper surface of said platform and extending a dimension of the platform, said members also having a lower course positioned below said platform;

a rotary driving means journaled on said frame below said platform and adapted to engage said members when said platform is at its lowered position, said driving means engaging the lower course of said members when said platform is in its bottom position;

control means operatively connected to said driving means to control the drive thereof and said driving means engaging, tensioning and driving said members when said platform is positioned at its lowered position.

4. In a case packer apparatus including a frame, a case lift member having an upstream margin and a downstream margin, means for supply of empty cases to said case lift member at its upstream margin, means for collecting groups of articles to be packed above said case lift member, and means on said frame for raising and lowering said case lift member whereby a group of articles can be deposited into a case on said case platform member when it is raised, the improvement comprising:

a pair of extensible belts journalled on said case lift platform and having an operative upper course extending from its upstream margin to its downstream margin and positioned slightly above the upper surface of said case lift member for support of cases on said member, said belts having a lower course below said case lift member with a section of said course having said belts positioned for free upward deflection; and a driven pulley means journalled on said frame below said case lift member and positioned to engage the lower course of said belts on the downward movement of the case lift member prior to completion of such movement to enable the drive of said belts towards the discharge margin of said case lift member to start prior to bottoming of said case lift member.

5. In case packer apparatus as in claim 4, where a plurality of pulleys engage and support said belts, said belts are made from polyurethane and have a rapid positive plastic memory whereby said belts can be stretched as said driven pulley means engage said belts which will stay in operative engagement with their positioning pulleys at all times.

6. In a case packer apparatus as in claim 5, where said driven pulley means have polyurethane covered belt engaging surfaces.

7. In a case packer apparatus as in claim 4, where continuous drive means are provided for the case packer apparatus and control means are provided for the drive of said driven pulley means to connect such pulley means to said continuous drive means only when said case lift member is being lowered and prior to any upward movement of said case lift member in its operative cycle.

8. In a case lift apparatus as in claim 1, where control means are provided to drive said roll means when said receiving platform is adjacent or at its lower extremity of movement.

9. In a case lift apparatus as in claim 3, where said members are resiliently loaded and their lower course is deflected from its position position by said driving means when said platform is approaching and in its bottom position.

10. In a case packer apparatus as in claim 4, where means position said belts in a triangularly shaped operative course, and said driver pulley means engage and deflect said belts at spaced portions of said section of said lower course.

11. In a case packer apparatus as in claim 4, wherein a set of plurality of pulleys are journalled on said case lift platform for each of said belts and said belts are mounted thereon, at lease one of said pulleys of each said set being positioned below and spaced from said case lift platfom to engage said belts and define an end of said section of said lower course.

* * * * *